US010233741B2

(12) United States Patent
Kronenberger et al.

(10) Patent No.: US 10,233,741 B2
(45) Date of Patent: Mar. 19, 2019

(54) WELL MONITORING, SENSING, CONTROL AND MUD LOGGING ON DUAL GRADIENT DRILLING

(71) Applicant: HALLIBURTON ENERGY SERVICES, INC., Houston, TX (US)

(72) Inventors: Kurt Adam Kronenberger, Spring, TX (US); Mathew Dennis Rowe, Lafayette, LA (US); Patrick Gregory McCormack, Baton Rouge, LA (US); Hunter Terrance Guchereau, Lafayette, LA (US); Bradly Shawn Hogan, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 514 days.

(21) Appl. No.: 14/787,994

(22) PCT Filed: May 30, 2014

(86) PCT No.: PCT/US2014/040259
§ 371 (c)(1),
(2) Date: Oct. 29, 2015

(87) PCT Pub. No.: WO2014/194210
PCT Pub. Date: Dec. 4, 2014

(65) Prior Publication Data

US 2016/0102541 A1 Apr. 14, 2016

Related U.S. Application Data

(60) Provisional application No. 61/829,718, filed on May 31, 2013.

(51) Int. Cl.
*E21B 44/00* (2006.01)
*E21B 47/00* (2012.01)
(Continued)

(52) U.S. Cl.
CPC ..... *E21B 47/00* (2013.01); *E21B 21/001* (2013.01); *E21B 21/08* (2013.01); *E21B 44/00* (2013.01)

(58) Field of Classification Search
None
See application file for complete search history.

(56) References Cited

U.S. PATENT DOCUMENTS 6,152,246 A 11/2000 King et al.
6,607,042 B2 * 8/2003 Hoyer ..... E21B 21/08 175/38
(Continued)

FOREIGN PATENT DOCUMENTS

CN 1688793 A 10/2005
CN 102007264 A 4/2011
(Continued)

OTHER PUBLICATIONS

"Methods of Achieving a Dual Gradient for Use in Deepwater Drilling," Dual Gradient Systems, source: http://www.dgdrilling.com/documents/Dual%20Gradient%20Technologies.pdf, Feb. 23, 2011.
(Continued)

*Primary Examiner* — Peter Macchiarolo
*Assistant Examiner* — Jermaine Jenkins
(74) *Attorney, Agent, or Firm* — Jason Sedano; Baker Botts L.L.P.

(57) ABSTRACT

The present disclosure provides systems and methods for tracking system parameters in each of two or more circulatory systems, such as in a dual gradient drilling system. The systems and methods may include defining each of multiple circulatory systems and simultaneously tracking one or more system parameters for each circulatory system. Systems and methods may further include tracking a discrete portion of
(Continued)

fluid circulating in each circulatory system, and associating one or more system parameters with each tracked discrete portion of fluid. Such association may be maintained as each portion of fluid circulates in each respective circulatory system.

14 Claims, 4 Drawing Sheets

(51) Int. Cl.
*E21B 21/00* (2006.01)
*E21B 21/08* (2006.01)

(56) References Cited

U.S. PATENT DOCUMENTS 7,090,036 B2 * 8/2006 deBoer ..... E21B 21/001 175/66
7,093,662 B2 * 8/2006 deBoer ..... E21B 21/001 166/250.07
7,278,496 B2 10/2007 Leuchtenberg
7,789,162 B2 * 9/2010 Keller ..... E21B 43/10 166/313
8,033,335 B2 * 10/2011 Orbell ..... E21B 17/085 166/268
8,162,063 B2 4/2012 Humphreys
8,322,439 B2 * 12/2012 Fossli ..... E21B 21/001 166/358
9,328,575 B2 * 5/2016 Feasey ..... E21B 21/08
9,822,625 B2 * 11/2017 Savari ..... E21B 21/003
2003/0062199 A1 4/2003 Gjedebo
2003/0217866 A1 11/2003 deBoer
2004/0065440 A1 4/2004 Farabee et al.
2008/0302570 A1 12/2008 DeBoer
2011/0036588 A1 2/2011 Heironimus
2012/0037361 A1 * 2/2012 Santos ..... E21B 21/08 166/250.08
2012/0067590 A1 3/2012 Fossli
2012/0234550 A1 * 9/2012 Dietz ..... E21B 21/08 166/344
2014/0262283 A1 * 9/2014 Savari ..... E21B 43/25 166/305.1

FOREIGN PATENT DOCUMENTS

CN 102080510 A 6/2011
WO 2011/047236 A1 4/2011

OTHER PUBLICATIONS

"Automatic Detection of Reservoir Influx in Conventional Drilling, Managed Pressure Drilling and Dual Gradient Drilling," Sigmund Petterson, Masters' Thesis, University of Stavanger, 2012.
"Ultra-Deepwater Riserless Mud Circulation with Dual Gradient Drilling," Greg Myers, source: http://www.iodp.org/iodp_journals/7_Ultra_Deepwater_Riserless_SD6.pdf, 2008.
"Drilling—SPT Group," Schlumberger, source: http://www.sptgroup.com/en/Solutions/Online-Solutions/Drilling/, 2013.
International Search Report and Written Opinion issued in related PCT Application No. PCT/US2014/040259 dated Oct. 15, 2014, 14 pages.
Office Action issued in related CN Application No. 201480022606.3, dated Sep. 4, 2017 (6 pages).

* cited by examiner

| | BIT | HOLE |
|---|---|---|
| MD | 1247.68 | 1251.02 |
| TVD | 1247.68 | 1251.02 |

| | BIT | HOLE |
|---|---|---|
| MD | 1264.93 | 1280.02 |
| TVD | 1264.93 | 1280.02 |

WELL MONITORING, SENSING, CONTROL AND MUD LOGGING ON DUAL GRADIENT DRILLING

CROSS-REFERENCE TO RELATED APPLICATION

This application a U.S. National Stage Application of International Application No. PCT/US2014/040259 filed May 30, 2014, which is based on and claims priority to U.S. Provisional Patent Application No. 61/829,718 filed 31 May 2013, both of which are incorporated herein by reference for all purposes.

BACKGROUND

Drilling operations play an important role when developing oil, gas or water wells or when mining for minerals and the like. A drilling fluid such as drilling mud is typically injected into a wellbore when performing drilling operations. The drilling fluid may for example be water, a water-based mud, an oil-based mud, or another drilling fluid. During the drilling operations, a drill bit passes through various layers of earth strata as it descends to a desired depth. Drilling fluids are commonly employed during the drilling operations and perform several important functions including, but not limited to, removing the cuttings from the well to the surface, controlling formation pressures, sealing permeable formations, minimizing formation damage, and cooling and lubricating the drill bit.

Dual gradient drilling systems may provide significant advantages over conventional fluid circulatory systems, particularly in undersea drilling applications. As noted, drilling fluids used in drilling a well may provide pressure in the open wellbore in order to prevent the influx of fluid from the formation. Thus, the pressure in the open wellbore is typically maintained at a higher pressure than the fluid pressure in the formation (the pore pressure). On the other hand, drilling fluid circulation also typically is controlled so as to be below the fracture pressure, the point at which a formation fracture can occur (the fracture pressure). Once the formation fractures, returns flowing in the annulus may exit the open wellbore thereby decreasing the fluid column in the well. If this fluid is not replaced, the wellbore pressure can drop and allow formation fluids to enter the wellbore, causing a kick and potentially a blowout. Thus, within a formation, it may be desirable to circulate drilling fluids in the well such that well pressure is maintained between the pore pressure and the fracture pressure.

This system may be complicated in undersea drilling applications, particularly deep sea drilling applications wherein the allowable pressure gradient of formations below the mudline may be significantly reduced as compared to conventional drilling operations due to the resulting difference in overburden due to seawater as compared to conventional rock formations. At the same time, pressure in the casing above the mudline (through the seawater) must also be maintained such that seawater does not breach the casing.

Accordingly, dual gradient drilling systems may be used to isolate the borehole pressure gradient below the mudline or sea floor from the drilling mud pressure gradient above (that is, in the casing through the seawater). Whereas single gradient drilling technology seeks to control wellbore pressure using a column of substantially constant-density drilling fluid from the bottom of the well back to the rig, dual-gradient drilling may use a lower density fluid, in some instances about the same density as seawater, from the rig to the seafloor, and then uses a heavier density drilling fluid below the mudline—that is, within the actual formation, between the seafloor and the bottom of the well. Dual-gradient drilling techniques may, in effect, simulate the drilling rig being located on the seafloor and therefore avoid some of the problems associated with deep-water drilling.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features.

Figure 1:
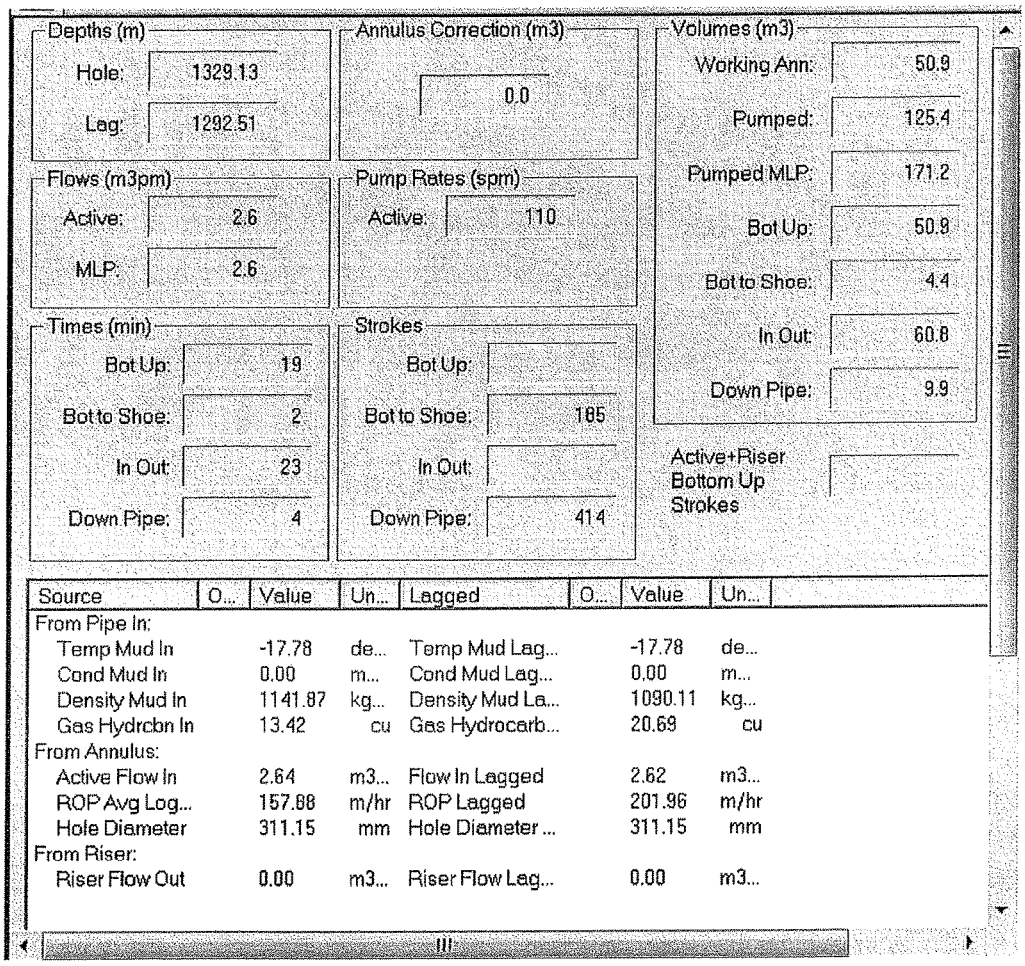
FIG. 1 is a depiction of monitored parameters in an example software program implementing well monitoring systems and methods of some embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling"

("LWD") is the term generally used for similar techniques that concentrate more on formation parameter measurement. Devices and methods in accordance with certain embodiments may be used in one or more of wireline, MWD and LWD operations.

Dual gradient drilling systems in some cases may present significant complications over single gradient systems. For instance, such systems may use two or more circulating systems simultaneously in order to accomplish the dual gradient effect herein described. Monitoring the interactions between the fluids of each circulating system, and monitoring each system simultaneously, may pose significant challenges in several drilling applications such as: control of each circulating system; monitoring of each circulating system (e.g., so as to alert an operator as to potential problems such as leaks, kicks, and/or the possibility of impending blowout); and mud logging (e.g., by identification of the depth of a portion of drilling fluid, cuttings within the drilling fluid, or the bit, so as to identify the depth from which a cutting or rock sample has been taken for accurate mud logging).

The present disclosure in some embodiments provides the ability to monitor a plurality of circulating systems and simultaneously to track fluids, cuttings, gas, and any one or more of multiple other properties associated with drilling fluids and/or drilling fluid circulatory systems through the well bore and all other systems of or associated with a drilling operation and/or well. Some embodiments of the disclosure may also permit identification of fluids and cuttings through both systems simultaneously and to correctly attach a bit depth or other depth related to wellbore, riser, and/or drill string to fluids based on time and plurality of pumps and pipe sizes that are transversed.

Systems, methods, and apparatus for monitoring, sensing, control, and mud logging with a dual gradient drilling system may be useful for a variety of purposes, including tracking fluids, cuttings, gas, and any other items known in the art to be circulated in or with drilling fluids through the well bore and all other systems of or associated with the well simultaneously. This tracking may in some embodiments allow a bit depth or other depth related to the wellbore, riser, or drill string to be attached to fluids, cuttings, or any other component of, or circulated with, a drilling fluid.

The terms "simultaneous", "simultaneously" or the like, as used herein, are not by themselves meant to limit the tracking, monitoring, and other functions so described so as to require occurrence at the exact same time. For example, in some embodiments, tracking or monitoring may take place by way of a unified process, or they may take place approximately (although not precisely) concurrently. Nonetheless, in some embodiments, tracking or monitoring may take place at the same time (within reasonable margins known in the art of drilling monitoring and control). "Simultaneous" and "simultaneously" include at least these concepts.

The present application describes systems, methods, and apparatus for well monitoring, sensing, controlling, and/or mud logging that are capable of tracking any one or more of several system parameters of a plurality of circulating or other systems simultaneously. Such parameters include, but are not limited to: fluids, cuttings, gas, changes in density, sweeps, cement, tracer material, alternative materials and fluids, equipment parameters, monitoring of trips on a plurality of systems simultaneously, bit and/or hole depth (both measured depth MD and true vertical depth TVD), fluid flow rates and circulation times, fluid volumes in various portions of a well bore (e.g., volume in annulus, volume down pipe, volume pumped), torque (e.g., top drive torque), pressure, equivalent circulating density (ECD), drive, inlet pressure and stroke rates for various pumps within the system (such as, e.g., a mud lift pump used for providing necessary pressure to deliver mud or other drilling fluid from the seafloor up the mud return line and to the drilling rig at the ocean's surface; or a seawater pump used for delivering pressured seawater to a mud lift pump to hydraulically power the mud lift pump; or a pump associated with any one or more circulating systems associated with a well). Parameters may also include (but are not limited to) top-of-mud (e.g., the highest point at which mud or another drilling fluid is located within a drill pipe, riser, mud return line, or other fluid flow line associated with a circulating system), and any parameter associated with the operation of a subsea rotating device (which may be a device set on or near the seafloor used to divert mud or other drilling fluid out of the annulus so as to establish a dual gradient environment). Such parameters associated with a subsea rotating device may include: SRD Bypass Setpoint (e.g., a setpoint pressure at which the SRD may be opened or closed); pressure above the SRD (e.g., in the riser or portion of the wellbore above the SRD); pressure below the SRD (e.g., annulus or other pressure in the wellbore below the SRD, and/or below the seafloor); and differential pressure (the difference between pressure-above and pressure-below the SRD). Measurements of actual values for any one or more parameters may in some embodiments be obtained by conventional means (e.g., downhole measurement tools for various monitored parameters such as annular flow rate and various pressures, mud logging methods for cuttings, rock samples, gas samples, and other formation parameters, etc.). Parameters may instead or in addition be calculated based upon models, actual measurements, or any combination thereof. One of ordinary skill in the art with the benefit of this disclosure will recognize the various means of obtaining values for parameters to be tracked in accordance with the present disclosure.

In some embodiments, any one or more of these parameters may be attached or associated to a discrete portion of drilling or other fluid within a circulating system within the well, which discrete portion is tracked throughout its circulation. In some embodiments, the attached or associated parameters may remain associated to that discrete fluid portion throughout its circulation. In some embodiments, the parameters may be updated at various times (e.g., to reflect modifications due to measured actual values, new calculated values based on changed conditions, or the like). FIG. 1 shows a screen shot of a software program implementing systems and methods of some embodiments of the present disclosure, in which some examples of the above and other parameters (e.g., mud temperature ("Temp Mud"), mud conductivity ("Cond Mud"), etc. are tracked for a portion of fluid, and associated with that portion of fluid as it circulates in a circulating system. In addition, in some embodiments, tracked parameters may also or instead be of the system (e.g., ROP, hole depth, pump rates, strokes). These parameters may or may not be associated with the discrete fluid portion, for example, where a pump rate parameter is associated with a discrete fluid portion, that pump rate parameter may, in some embodiments, represent the rate of pumping at the time that fluid portion was pumped, although it may or may not be the current pump rate. In some embodiments, parameters may also or instead be associated with a particular location within a well (e.g., annulus, pipe in, riser, mud return line, etc.).

In some embodiments, any one or more of the various parameters may be tracked on a single system, as well. In other embodiments, any one or more of these parameters may be tracked separately for each of two or more systems. In other embodiments, any one or more of these parameters may be tracked jointly and/or continuously through two or more systems. And in some embodiments, the present disclosure may provide for tracking of any combination of the aforementioned systems or combination of systems (e.g., tracking parameters separately for each of two or more circulating systems while also tracking parameters jointly and/or continuously through the two or more circulating systems). In some embodiments, the systems may be circulating systems (e.g., a system that circulates any one or more of drilling fluid comprising a drilling mud, seawater, a fluid of similar density to seawater, and a fluid with lower density than the drilling fluid comprising the drilling mud). Circulating systems of some embodiments may also or instead include a system that circulates any one or more of air, foam, cement, fracturing fluids, spacer fluids, or any solid, liquid, or gas that comes into and out of the wellbore.

The systems and methods of the present disclosure described herein may be implemented in software to run on one or more computers, where each computer includes one or more processors, a memory, and may include further data storage, one or more input devices, one or more output devices, and one or more networking devices. The software includes executable instructions stored on a tangible medium.

In some embodiments, the systems, methods, and apparatus may be implemented in conjunction with a dual gradient drilling system. In some embodiments, any one or more of the systems may comprise a drilling fluid circulating system. In some embodiments, any one or more of the systems may comprise a riser fluid circulation system for circulating a riser fluid (such as seawater, fluid with density similar to seawater, and/or fluid with density lower than the drilling mud or other drilling fluid of the drilling fluid circulating system). Such riser fluid comprising seawater or a fluid with similar density to seawater may be circulated in part in a drill casing annulus passing through the ocean between a drilling rig and a sea floor surface.

Figure 2A:
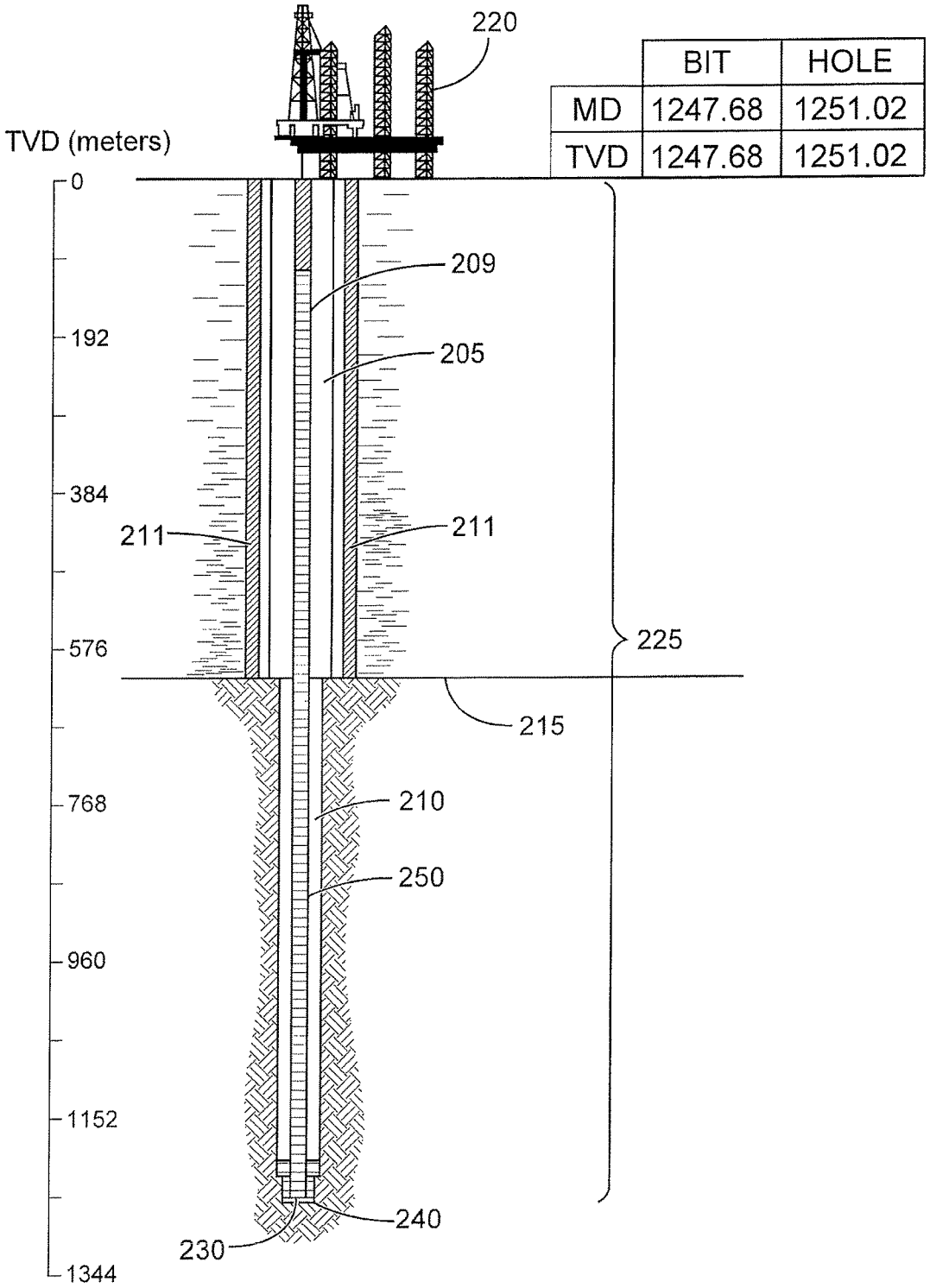
FIGS. 2*a*, 2*b*, and 2*c* are each a depiction of a diagram of a well bore system that may be monitored according to some embodiments of the present disclosure, showing different locations of tracked fluid in a circulating system associated with a well.
Figure 2B:
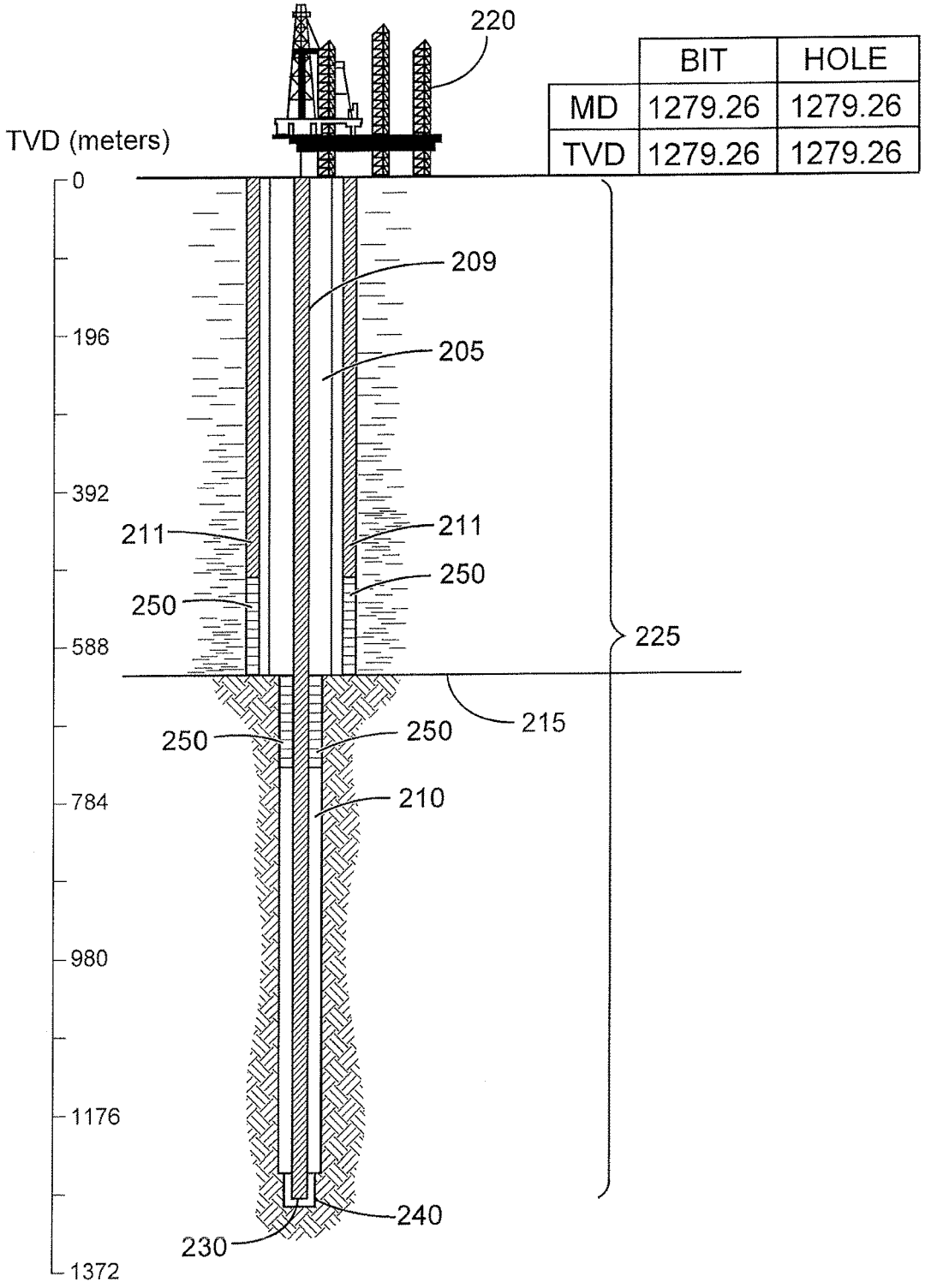
Figure 2C:
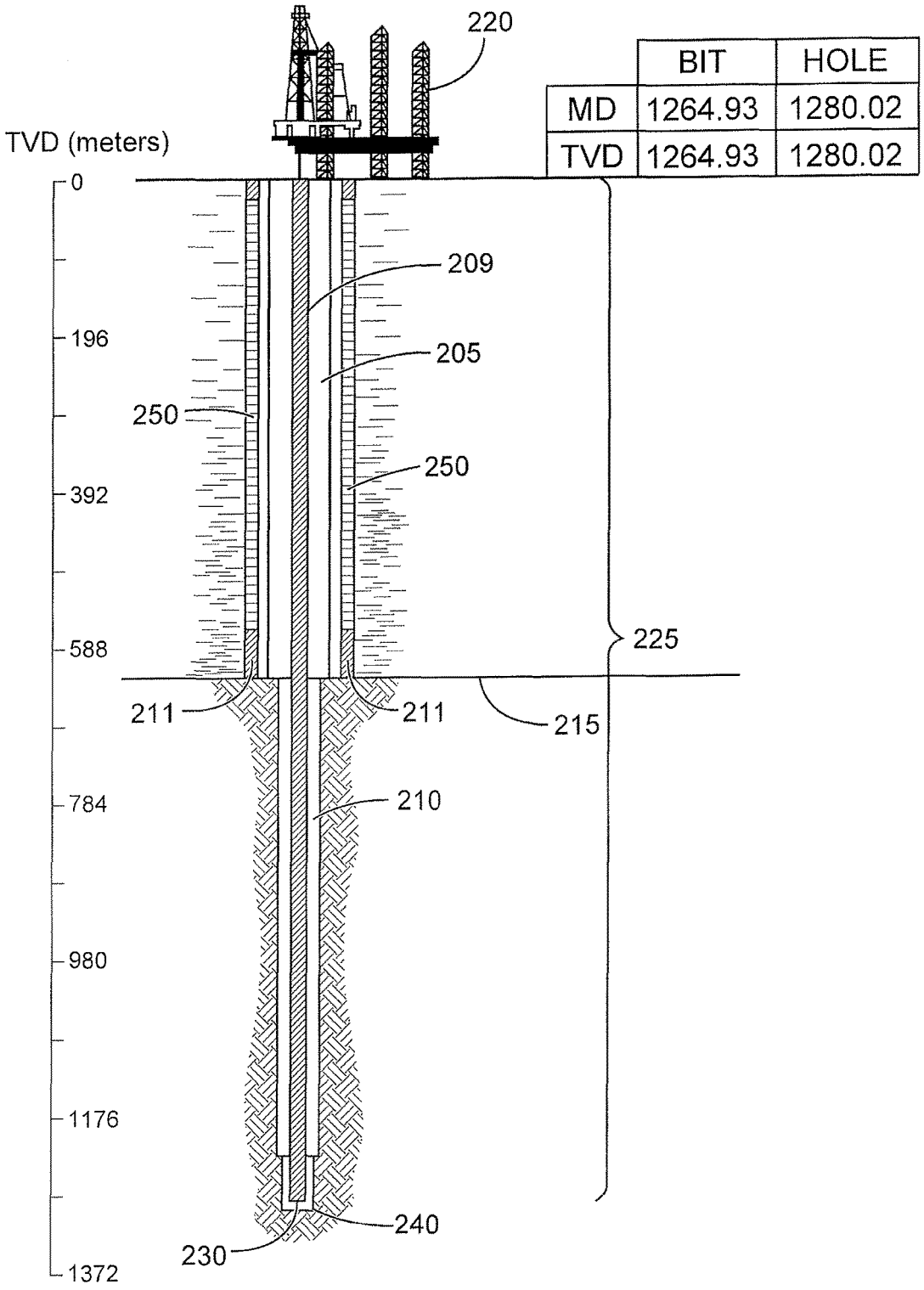

For example, as shown in FIGS. 2*a*, 2*b*, and 2*c*, parameters may be tracked in a dual gradient drilling system for a first circulating system and a second circulating system. In the example depicted in FIGS. 2*a*, 2*b*, and 2*c*, the second circulating system includes a system for circulating a drilling fluid, such as drilling mud, down casing string 209, out of the casing string at the bit 230, up the subsurface portion (i.e., below the mudline or seafloor 215) of the annulus 210, and then up one or more mud return lines 211. Although FIGS. 2*a*, 2*b*, and 2*c* show two mud return lines, systems and methods of the present disclosure may be used in conjunction with drilling systems employing one mud return line, or three or more mud return lines, as well as two. FIGS. 2*a*, 2*b*, and 2*c* show the path of a discrete portion of drilling fluid such as mud (250) as may be tracked by some embodiments of the present disclosure through its circulation within a system: here, it is tracked down the casing string 209 and out of the string 209 at the drill bit 230 in FIG. 2*a*; up the subsurface portion of the annulus 210 and into the mud return lines 211 in FIG. 2*b*; and up the mud return lines 211 to the rig 220 in FIG. 2*c*. In the same example, the first circulating system includes a system for circulating (within the annulus 205 of the drill string above the seafloor or mudline, e.g., within the riser) a riser fluid such as seawater, a fluid with like density with seawater, and/or a fluid with lower density than the drilling fluid (such as mud) that is circulated in the second circulating system. Both the first and second circulating systems are associated with the same drilling rig 220 and well 225, and may in some embodiments alternatively be labeled drilling fluid and riser circulating systems, respectively. In addition, some drilling systems may further comprise a choke line used for counteracting heightened downhole formation pressure (e.g., during a kick or blowout). Return flow of mud or other drilling fluid may be diverted from the mud riser(s) to a choke line (not shown in FIGS. 2*a*, 2*b*, and 2*c*), which may be controlled by a valve (e.g., on the drilling rig) so as to provide downward pressure, in combination with the downward pressure of the mud itself in the choke line, so as to counteract the upward-driving downhole pressure in, e.g., a kick or blowout situation. In some embodiments, various parameters with such a choke line (e.g., pressure, mud or other flow rate, location, path, etc. within the line) may be tracked in accordance with tracking of the various other parameters discussed herein.

In some embodiments, tracking may comprise any one or more of the following, in any order or combination: Define pathways for a plurality of circulating systems simultaneously in dual gradient drilling application; Determination of output from surface and/or subsea pumps taking into account efficiency to track pumped volumes simultaneously through a plurality of systems in a dual gradient drilling application; Compare a theoretical model to actual circulating time/strokes/volumes for a plurality of circulating systems; track a control volume simultaneously through a plurality of circulating systems using theoretical and actual system models for dual gradient drilling; using ROP (rate of penetration) and drill pipe length vs. time, tracking a control volume of solids or fluids from drilled formation using theoretical and actual system models simultaneously through a plurality of systems on a dual gradient drilling application; and/or tracking the aforementioned system parameters of a plurality of circulating or other systems.

Again referring to the example depicted in FIGS. 2*a*, 2*b*, and 2*c*, a volume of drilling fluid such as mud (250) may be tracked as it trips in, trips out, and/or circulates through one system, while simultaneously a volume of fluid in another circulating system (for circulating, e.g., a riser fluid such as seawater or other fluid in annulus 205) may be tracked as it trips in, trips out, and/or circulates in that other circulating system (not shown in FIG. 2). Parameters such as flow rate, flow volume, density, and other parameters associated with each fluid in addition to location (as shown for drilling fluid 250 in FIG. 2), as well as any other parameter herein discussed, may also be tracked in accordance with the present disclosure.

In some embodiments, the present disclosure may provide a method for tracking a plurality of circulation systems, as well as parameters thereof, on or associated with a well bore. This method may include defining each of one or more systems associated with a well bore. In some embodiments, any one or more of these systems may be a circulating or circulatory system.

Defining each of one or more systems associated with a well bore may comprise any one or more of the following: define any one or more drill string components including, but not limited to, inner and outer diameter; define annular components, including but not limited to inner and outer diameter; define inner diameter(s) of any one or more circulation lines; define output of any one or more surface pumps; define output of any one or more seafloor pumps (e.g., in some embodiments, mud lift pumps and/or subsea rotating devices, among others); define signal from any one or more pumps (which may, in some embodiments, allow for monitoring a pump rate for any one or more pumps); define all fluid suction and return vessels; define signals from any one or more sensors on suction and/or return vessels (which may, in some embodiments, allow for monitoring capacity); and define signals from any one or more sensors associated with any one or more flow out lines (which may, in some embodiments, allow for monitoring flow rate).

In some embodiments, methods of the present disclosure may instead or in addition include any one or more of the following: defining one or more end points for each of the one or more systems associated with the well bore; defining fluid composition for each of the one or more systems associated with the well bore; defining fluid density in and out of each of the one or more systems associated with the well bore; and monitoring drill string position in any one or more systems. Monitoring drill string position may include any one or more of: tripping into hole; tripping out of hole; location of changes in outer and inner drill string. By way of example, in some embodiments as shown in FIGS. 2*a*, 2*b*, and 2*c*, location of the drill bit 230 may be monitored, as well as location of the bottom of the hole 240. These may, in some embodiments, be reported as either or both of measured depth (MD) or total vertical depth (TVD) of each, as shown in FIGS. 2*a*, 2*b*, and 2*c*.

Monitoring in some embodiments may take place while drilling, although in other embodiments it may take place while cementing or while with drill string in well bore during any operation in close or open hole with fluid in the well bore. Monitoring in other embodiments may take place during any one or more of the aforementioned activities.

In some embodiments, methods of the present disclosure may instead or in addition include monitoring flow rates in and/or out on each of the one or more systems by monitoring all pumps and/or flow rates. Methods may further or instead include using any one or more of time, flow rate, drill string, and/or well bore volumes, track fluids, sweeps, cement, and/or other items through each system associated with the well bore. And, in some embodiments, methods may further or instead include monitoring and/or tracking bottom hole pressure and/or its changes as a function of depth. In some embodiments, this may be carried out using any one or more of time, flow rate, drill string location, well bore volumes, rate of penetration, fluid densities, drill string components, and other down hole and well pore pressure control devices.

In some embodiments, methods may instead or in addition include monitoring and/or associating a lag value with any one or more measured parameters. This could, for example, aid in associating a precise time and/or location with any given measurement of a parameter, and/or with any given discrete portion of tracked fluid. For example, in some embodiments, methods may include tracking lagged ROP, lagged annulus in-flow rate, lagged mud density, and other lagged parameters, which measurements may account for lag time between the time of measurement of a given parameter, and the time of receipt of a signal indicating such measurement. FIG. 1 shows examples of lag values alongside other parameter measurements in an embodiment wherein various methods of the present disclosure are implemented via software to run on one or more computers.

In some embodiments, methods may further or instead include defining a model of each of the one or more systems associated with the well bore, and comparing any one or more of the monitored or tracked parameters discussed herein with the expected parameters as described by the associated model for each respective system. In some embodiments, methods may further or instead include alerting an operator (either automated or human) to conditions indicative of a problem in any one or more system associated with the well bore, such as a potential kick, blowout, leak, etc. In some embodiments, methods may further or instead include using the disclosed monitoring systems and methods in conjunction with (e.g., by interfacing with) systems and methods for controlling each of the one or more systems so as to align any one or more tracked or monitored parameters more closely with the expected parameters.

In some embodiments, the methods of the present disclosure may further include using monitored or tracked drill string position and/or fluid position so as to identify a downhole location from which a cutting, core sample, or other rock sample has been obtained, e.g., for mud logging. In other embodiments, methods may similarly include identifying a downhole location associated with any solid, gas, or liquid (such as, e.g., tracer materials, drilling fluids, cuttings, etc.).

By way of example, in some embodiments, a time of measurement may be associated with a particular bit and/or hole depth, as well as with a specific portion of tracked fluid 250 (and associated parameters). For instance, as shown in FIG. 2*a*, a portion of drilling fluid (such as mud) 250, including mud at the bottom of the hole 240, is tracked, and may be associated with hole depth 1251.02 (both MD and TVD) as shown in FIG. 2*a*. This portion 250 may be tracked through its journey back to the rig 220 as shown in FIGS. 2*b* and 2*c*, maintaining association with hole depth 1251.02 in order to associate a particular depth with any tracked gas, liquid, or solid samples (e.g., rock samples such as cuttings, tracer fluids, etc.).

In some embodiments, any one or more methods of the present disclosure may be implemented in software to run on one or more computers, where each computer includes one or more processors, a memory, and may include further data storage, one or more input devices, one or more output devices, and one or more networking devices. The software includes executable instructions stored on a tangible medium.

As one specific example, in one embodiment a system or method of the present disclosure may include simultaneous monitoring of two circulatory systems in a dual gradient drilling application, as previously referenced with respect to FIGS. 2*a*, 2*h*, and 2*c*. As noted previously, dual-gradient drilling may be used for deep-water drilling applications in which hydrostatic pressure is maintained by circulating seawater (or fluid of like density, and/or fluid of lower density than the drilling mud) above the sea floor and mud below the sea floor. This may require two separate circulatory systems (e.g., a first system for the seawater (or like-density fluid, or fluid with density less than the mud), in annulus 205 above the mud line or seafloor, and a second system for the drilling fluid (such as mud), as described above to include casing string 209, annulus 210 below the mud line or seafloor, and mud return lines 211.

In such an embodiment, the present disclosure may provide a system or method capable of tracking and/or monitoring both circulatory systems simultaneously. Each of the seawater and mud circulatory systems may be defined in accordance with the above description of defining each of one or more systems associated with a well bore, defining end points for each circulatory system, defining fluid composition for each circulatory system, and defining fluid density in and out of each circulatory system. Then, any one or more of a variety of observations may be made in accordance with monitoring drill string position in both circulatory systems (tripping into hole, tripping out of hole, location of changes in outer and inner drill string). Monitoring may take place during any one or more of: while drilling, while cementing, and while the drill string is in the well bore during any operation in close or open hole with fluid in the well bore. Combining the sets of information for each of the seawater and mud circulatory systems, the disclosed system or method in such an example embodiment (and systems of other embodiments) may be used to monitor borehole conditions, compare achieved performance to expected performance, optimize settings, and/or detect kicks. The system or method may also or instead be used to identify a precise downhole position from which a cutting originated for purposes of, e.g., mud logging.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are each defined herein to mean one or more than one of the elements that it introduces.

What is claimed is:

1. A method comprising:

defining each of a first and a second circulatory system associated with a wellbore, the first circulatory system comprising a first fluid circulating therein, and the second circulatory system comprising a second fluid circulating therein;

simultaneously tracking: (i) one or more first circulatory system parameters, each first circulatory system parameter being associated with the first circulatory system; and (ii) one or more second circulatory system parameters, each second circulatory system parameter being associated with the second circulatory system;

simultaneously tracking (i) a first discrete portion of the first fluid through the first circulatory system; and (ii) a second discrete portion of the second fluid through the second circulatory system;

wherein each first circulatory system parameter and each second circulatory system parameter is selected from the group consisting of: fluids; cuttings; gas; changes in density; sweeps; cement; tracer material; number of trips; bit depth; hole depth; fluid flow rate; fluid volume in any discrete portion of the wellbore; torque; pressure; equivalent circulating density; drive, inlet pressure, or stroke rate of any one or more pumps within each circulatory system; top-of-mud; subsea rotating device (SRD) bypass setpoint; pressure above the SRD; pressure below the SRD; SRD differential pressure; mud temperature; mud conductivity; and any combination thereof.

2. The method of claim 1, wherein each of tracking the first discrete portion and tracking the second discrete portion comprises tracking pumped volumes of each of the first and second discrete portions based at least in part upon determination of output from surface pumps, subsea pumps, and any combination thereof, each of said surface pumps and subsea pumps being associated with one or both of the first circulatory system and the second circulatory system.

3. The method of claim 1, wherein each of tracking the first discrete portion and tracking the second discrete portion comprises comparing a theoretical model to actual circulating time for each of the first and second fluids.

4. The method of claim 1, wherein each of tracking the first discrete portion and tracking the second discrete portion comprises tracking a control volume of solids or fluids from a drilled formation penetrated by the wellbore, said tracking of the control volume being based upon rate of penetration and drill pipe length vs. time.

5. The method of claim 1, further comprising: associating one or more of the first circulatory system parameters with the first discrete portion of the first fluid; associating one or more of the second circulatory system parameters with the second discrete portion of the second fluid; and simultaneously tracking: (i) the discrete portion of the first fluid and the one or more parameters associated therewith, and (ii) the discrete portion of the second fluid and the one or more parameters associated therewith.

6. The method of claim 1, further comprising: defining one or more end points for each of the first and second circulatory systems; defining fluid composition of each of the first and second fluids; defining fluid density of the first fluid in the first circulatory system; and defining fluid density of the second fluid in the second circulatory system.

7. The method of claim 6, further comprising monitoring the position of a drill string that includes at least a portion of any one or more of the first and second circulatory systems.

8. The method of claim 1, wherein defining each of the first and the second circulatory system comprises:

defining components of a drill string, said components comprising inner and outer diameter of the drill string, the drill string including at least a portion of any one or more of the first and second circulatory systems;

defining an inner and outer diameter of an annulus between the outer diameter of the drill string and the wellbore;

defining inner diameters of each of one or more circulation lines, each circulation line including at least a portion of any one or more of the first and second circulatory systems;

defining output of each of one or more surface pumps associated with any one or more of the first and second circulatory systems;

defining output of each of one or more seafloor pumps associated with any one or more of the first and second circulatory systems;

defining one or more pump signals, each pump signal allowing for monitoring pump rate of one of the surface pumps, one of the seafloor pumps, or both;

defining all fluid suction and return vessels associated with any one or more of the first and second circulatory systems;

defining signals from the fluid suction and return vessels; and defining signals from a sensor associated with any one or more flow out lines, each flow out line being associated with any one or more of the first and second circulatory systems.

9. A method comprising:

defining each of a seawater and a mud circulatory system associated with a wellbore, the seawater circulatory system comprising a riser fluid circulating therein, and the mud circulatory system comprising a drilling fluid circulating therein;

defining an end point for each of the seawater and mud circulatory systems;

defining fluid composition for each of the riser fluid and drilling fluid;

defining fluid density for each of the riser fluid and drilling fluid;

monitoring position of a drill string that includes at least a portion of any one or more of the seawater and mud circulatory systems;

monitoring flow rate of the riser fluid in and out of the first circulatory system;

monitoring flow rate of the drilling fluid in and out of the second circulatory system; and simultaneously tracking any one or more system parameters for each of the seawater and mud circulatory systems, each system parameter being selected from the group consisting of fluids; cuttings; gas; changes in density; sweeps; cement; tracer material; number of trips; bit depth; hole depth; fluid flow rate; fluid volume in any discrete portion of the wellbore; torque; pressure; equivalent circulating density; drive, inlet pressure, or stroke rate of any one or more pumps within each circulatory system; top-of-mud; subsea rotating device (SRD) bypass setpoint; pressure above the SRD; pressure below the SRD; SRD differential pressure; mud temperature; mud conductivity; and any combination thereof.

10. The method of claim 9, wherein defining each of the first and the second circulatory system comprises: defining the drill string's inner and outer diameter; and defining the inner and outer diameters of an annulus between the outer diameter of the drill string and the wellbore.

11. The method of claim 9, wherein simultaneously tracking any one or more system parameters for the seawater circulatory system comprises: associating one or more of the system parameters with a discrete portion of the riser fluid; tracking the discrete portion of the riser fluid and its one or more associated system parameters in the seawater circulatory system; associating one or more of the system parameters with a discrete portion of the drilling fluid; and tracking the discrete portion of the drilling fluid and its one or more associated system parameters in the mud circulatory system.

12. A software program including executable instructions stored on a non-transitory and tangible medium that, when executed, cause at least one processor of a computer to:

define each of a seawater and a mud circulatory system associated with a wellbore, the seawater circulatory system comprising a riser fluid circulating therein, and the mud circulatory system comprising a drilling fluid circulating therein;

define an end point for each of the seawater and mud circulatory systems;

define fluid composition for each of the riser fluid and drilling fluid;

define fluid density for each of the riser fluid and drilling fluid;

monitor position of a drill string that includes at least a portion of any one or more of the seawater and mud circulatory systems;

monitor flow rate of the riser fluid in and out of the first circulatory system;

monitor flow rate of the drilling fluid in and out of the second circulatory system; and simultaneously track any one or more system parameters for each of the seawater and mud circulatory systems, each system parameter being selected from the group consisting of fluids; cuttings; gas; changes in density; sweeps; cement; tracer material; number of trips; bit depth; hole depth; fluid flow rate; fluid volume in any discrete portion of the wellbore; torque; pressure; equivalent circulating density; drive, inlet pressure, or stroke rate of any one or more pumps within each circulatory system; top-of-mud; subsea rotating device (SRD) bypass setpoint; pressure above the SRD; pressure below the SRD; SRD differential pressure; mud temperature; mud conductivity; and any combination thereof.

13. The software program of claim 12, wherein the executable instructions, when executed to cause the at least one processor to define each of the seawater and the mud circulatory system, further cause the at least one processor to define the drill string's inner and outer diameter; and to define the inner and outer diameters of an annulus between the outer diameter of the drill string and the wellbore.

14. The software program of claim 12, wherein the executable instructions, when executed to cause the processor to simultaneously track any one or more system parameters for each of the seawater and mud circulatory systems, further cause the processor to: associate one or more of the system parameters with a discrete portion of the riser fluid; track the discrete portion of the riser fluid and its one or more associated system parameters in the seawater circulatory system; associate one or more of the system parameters with a discrete portion of the drilling fluid; and track the discrete portion of the drilling fluid and its one or more associated system parameters in the mud circulatory system.

* * * * *